US005722010A

United States Patent [19]

Okubo et al.

[11] Patent Number: 5,722,010

[45] Date of Patent: Feb. 24, 1998

[54] ELECTROPHOTOGRAPHIC PRINTER HAVING TRANSFERRING DEVICE WITH CONTROL MODE SWITCHING CONTROL

[75] Inventors: Takehiko Okubo; Toshikazu Ito; Toshiro Murano, all of Tokyo, Japan

[73] Assignee: Oki Data Corporation, Tokyo, Japan

[21] Appl. No.: 673,904

[22] Filed: Jul. 1, 1996

[30] Foreign Application Priority Data

Jul. 7, 1995 [JP] Japan ..... 7-171796

[51] Int. Cl.[6] ..... G03G 15/00; G03G 15/16

[52] U.S. Cl. ..... 399/66; 399/314

[58] Field of Search ..... 399/66, 297, 394, 399/313, 314

[56] References Cited

U.S. PATENT DOCUMENTS

| | | | |
|---|---|---|---|
| 5,179,397 | 1/1993 | Ohzeki et al. | 399/66 |
| 5,450,180 | 9/1995 | Ohzeki et al. | 399/50 |
| 5,598,256 | 1/1997 | Kimura et al. | 399/316 |

*Primary Examiner*—Joan H. Pendegrass

*Attorney, Agent, or Firm*—Panitch Schwarze Jacobs & Nadel, P.C.

[57] ABSTRACT

A sensor detects the leading edge of the print medium. A position counter counts a time length required for the print medium to advance from where the print medium is detected by the sensor to the photosensitive drum. The position counter also counts a time length for the print medium to advance past the photosensitive drum. The distance of the toner image from the leading edge of the print medium is determined on the basis of the image data of print data. A row counter counts the number of dots in a direction in which the print medium is transported and a column counter counts the number of dots in a direction perpendicular to the direction the print medium is transported. The distance between the first line of an image data and the line in which a first dot to be printed in the image data is determined on the basis of the contents of the column counter and the row counter. The controller switches the transferring device from the constant current control mode to the constant voltage control mode immediately before the first line is printed on the print medium, thereby allowing transferring of the toner image in accordance with the distance of the toner image from the leading edge of the print medium.

7 Claims, 11 Drawing Sheets

FIG.7

| $L_3$ (mm) | NUMBER OF LINES BEFORE FIRST BLACK DOT n-1 | NUMBER OF LINES FROM LEADING EDGE OF PAPER K + (n-1) | $L_2$ (mm) | DIFFERENCE $L_3 - L_2$ (mm) |
|---|---|---|---|---|
| 4.23 ~ 4.64 | 0 ~ 9 | 100 ~ 109 | 3.86 | 0.37 ~ 0.78 |
| 4.65 ~ 5.07 | 10 ~ 19 | 110 ~ 119 | 4.07 | 0.58 ~ 1.00 |
| 5.08 ~ 5.49 | 20 ~ 29 | 120 ~ 129 | 4.28 | 0.79 ~ 1.21 |
| 5.50 ~ 5.91 | 30 ~ 39 | 130 ~ 139 | 4.50 | 1.01 ~1.41 |
| 5.92 ~ 6.34 | 40 ~ 49 | 140 ~ 149 | 4.71 | 1.22 ~ 1.63 |
| 6.35 ~ 6.76 | 50 ~ 59 | 150 ~ 159 | 4.92 | 1.43 ~ 1.84 |
| 6.77 ~ 7.18 | 60 ~ 69 | 160 ~ 169 | 5.13 | 1.64 ~ 2.05 |
| 7.19 ~ 7.61 | 70 ~ 79 | 170 ~ 179 | 5.34 | 1.85 ~ 2.27 |
| 7.62 ~ 8.03 | 80 ~ 89 | 180 ~ 189 | 5.55 | 2.06 ~ 2.48 |
| 8.04 ~ 8.45 | 90 ~ 99 | 190 ~ 199 | 5.77 | 2.28 ~ 2.68 |
| 8.46 ~8.88 | 100 ~ 109 | 200 ~ 209 | 5.98 | 2.49 ~ 2.90 |
| 8.89 ~ 9.30 | 110 ~ 119 | 210 ~ 219 | 6.19 | 2.70 ~3.11 |
| 9.31 ~ | 120 ~ 129 | 220 ~ 229 | 6.4 | 2.91 ~ |

ELECTROPHOTOGRAPHIC PRINTER HAVING TRANSFERRING DEVICE WITH CONTROL MODE SWITCHING CONTROL

BACKGROUND OF THE INVENTION

The present invention relates to an electrophotographic printer.

With an electrophotographic printer, a charging device supplies static charges to a photosensitive drum. An LED head illuminates the photosensitive drum to form an electrostatic latent image on the photosensitive drum. Then, the electrostatic latent image is converted into a toner image by a developer. The toner image is then transferred to a print medium such as paper by means of a transferring device.

The transferring device has a transfer roller to which a positive high voltage is supplied. The transferring device is controlled first in the constant current control (referred to as CCC hereinafter) mode and when the voltage on the shaft of transfer roller (relative to the photosensitive drum which is grounded) is stabilized it is switched to the constant voltage control (referred to CVC hereinafter) mode, so as to ensure high quality print. A constant current is supplied to the load including the transfer roller in the CCC mode and a constant voltage is supplied to the load in the CVC mode.

FIG. 9 illustrates the position of leading edge of print paper 6 relative to the contact position a at various times $t_0$, $t_1$, $t_2$, and $t_3$ during printing operation. FIG. 1 illustrates the transfer operation of an electrophotographic printer. Referring to FIG. 9, point Pt on the photosensitive drum 2 indicates the leading edge of a toner image at the time $t_1$ when the leading edge of the print paper 6 is at the contact position 1. A sensor 25 detects print paper 6 which is transported at a constant speed and the transferring device enters the CCC mode at time $t_0$ to supply a load current to the transfer roller 7. Until the leading edge of the print paper 6 reaches the contact position a, the load of the transferring device consists of the transfer roller 7 only. The CCC mode of operation causes a high positive voltage to appear on the transfer roller 7 in accordance with the load, i.e., the transfer roller 7. The voltage rises gradually due to the capacitance of the load. The print paper 6 is transported a distance $L_1$ in a time length $T_1$ in the direction of arrow A. When the print paper 6 arrives at the transferring device at time $t_1$, the load of the transferring device now consists of the transfer roller 7 plus the print paper 6, and the voltage on the transfer roller 7 now depends on the new load, i.e., the print paper 6 plus the transfer roller 7. The print paper 6 is further transported a distance $L_2$ in a time length $T_2$. Then, the transferring device enters the CVC mode at time $t_2$. In the CVC mode, the voltage required to supply the load current to the print paper 6 plus transfer roller 7, is maintained. The print paper 6 is then further transported and the transfer of the toner image begins at time $t_3$ as the leading edge of the toner image reaches the contact position a.

The voltage on the transfer roller 7 in the CCC mode becomes more stable with time. For best print quality, it is desirable that the transferring device is switched from the CCC mode to the CVC mode only after the the voltage on the transfer roller has reached a stable value. The time required for the voltage on the transfer roller to reach a stable value varies depending on load conditions such as the kind of print medium. For example, OHP paper has a high impedance and requires a longer time before the voltage is stabilized. Switching from the CCC mode to the CVC mode before the voltage on the transfer roller reaches a stable or a nearly stable value results in poor print quality.

When the transfer of image begins at time $t_3$, the load of the transferring device changes from the combination of the transfer roller 7 and the print paper 6, to the combination of the transfer roller 7, the print paper 6, and a toner load. The toner load varies depending on the print image and is therefore not constant throughout the page being printed.

Conventionally, the transferring device is designed to switch from the CCC mode to the CVC mode at time $t_2$, which is before time $t_3$, regardless of whether the print start position on the print paper 6 is close to or far from the leading edge of the print paper 6. In other word, the transferring device is switched to the CVC mode a fixed time length, i.e., time length $T_2$ after the leading edge of the print paper 6 passes the contact position. This time length $T_2$ is selected to be long enough for the voltage on the transfer roller 7 to reach a stable value. If the print start position (leading edge of the toner image) on the print paper 6 is close to the leading edge of the print paper 6, the leading edge of the toner image on the drum at time $t_1$ is closer to the contact point a. For instance, it may be at point Pt' rather than point Pt. Then, the transfer of image begins at time $t_3'$, i.e., before the transferring device is switched from the CCC mode to the CVC mode. This is undesirable since the toner image printed in the CCC mode is different from that printed in the CVC mode. Therefore, for quality print, the transferring device must be switched from the CCC mode to the CVC mode before the transfer of image begins.

There are thus contradictory requirements: That is, the transferring device should be operated in the CCC mode as long a time as possible, so that the voltage on the transfer roller 7 is stable or nearly stable before the switching. Also, the switching should take place before the transfer of image begins. These requirements can be both met easily if the print inhibited-area near the leading edge of the print paper where printing is inhibited is wide, or if the printing speed is low. However, there are instances where the print-inhibited area is desired to be narrower, and there is an increasing demand for higher printing speed.

SUMMARY OF THE INVENTION

An object of the invention is to provide a printer in which a transferring device can cope with the demand for narrower print-inhibited-area and higher printing speed.

An electrophotographic printer has a transferring device which operates in a constant current control mode and then in a constant voltage control mode after the voltage on the transfer roller 7 becomes stable. Transfer of a toner image to a print medium is effected in the constant voltage control mode.

A controlling section calculates a distance L3 between the leading edge of the print medium and the first line to be printed on the print medium. A sensor detects the leading edge of the print medium. A position counter counts a time length T1 required for the print medium to advance from where the print medium is detected by the sensor to the photosensitive drum. The position counter also counts a time length T2 for the print medium to advance from the photosensitive drum to a position where the transferring device is switched from the constant current control mode to the constant voltage control mode.

The distance of the toner image from the leading edge of the print medium is determined on the basis of the print data sent from the host PC when print operation is activated. A row counter counts the number of lines of dots in the print area, the lines of dots extending in a direction perpendicular to the direction in which the print medium is transported.

The distance between the leading edge of the print area and the line to be first printed is determined on the basis of the content of the row counter.

The controller switches the transferring device from the constant current control mode to the constant voltage control mode immediately before the first line is printed on the print medium, thereby allowing transferring of the toner image in accordance with the distance of the toner image from the leading edge of the print medium.

BRIEF DESCRIPTION OF THE DRAWINGS

FIG. 7 shows a table in which the values of $L_3$, n−1, k+(n−1), $L_2$, and $L_3$–$L_2$ are listed.

FIG. 10 illustrates a sensor and a position counter for detecting when the paper arrives at the contact point a.

DESCRIPTION OF THE PREFERRED EMBODIMENTS

Construction

Figure 1:
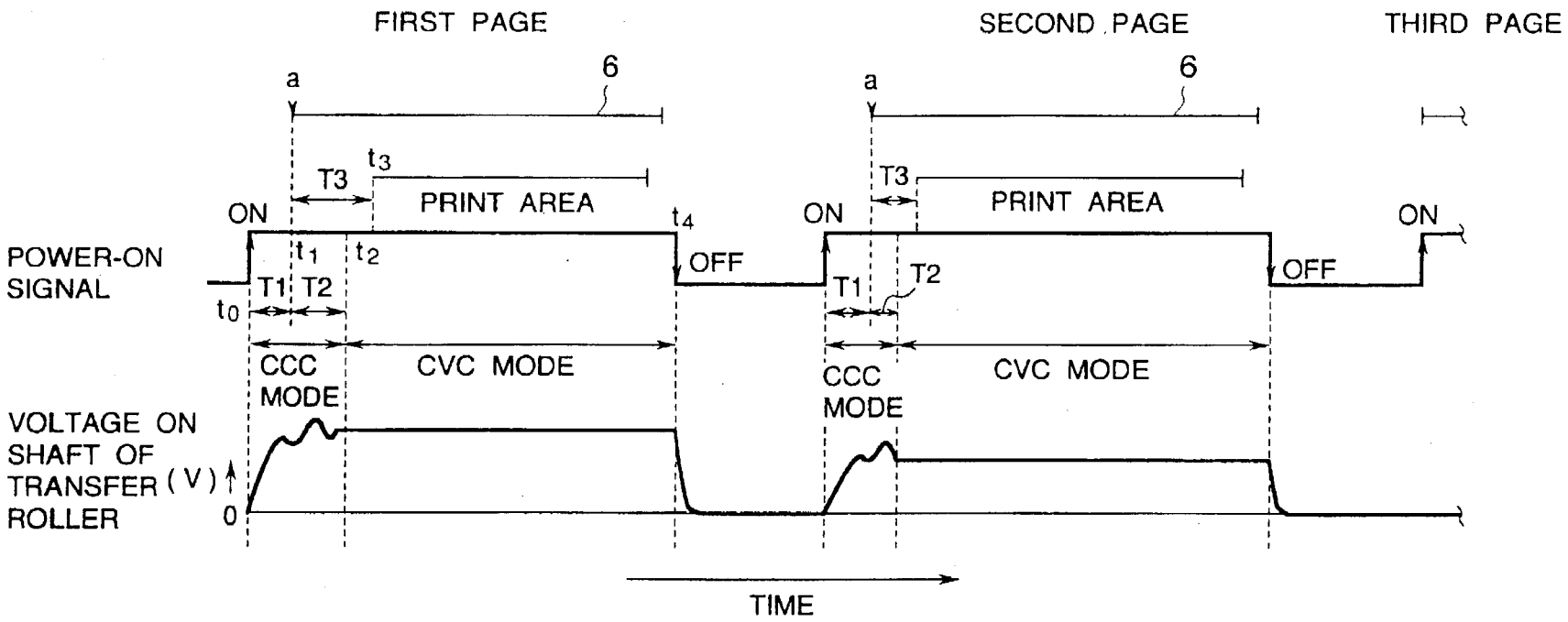
FIG. 1 is a timing chart illustrating the transfer operation of an electrophotographic printer according to the present invention.

The invention will now be described with reference to the accompanying drawings. Like elements have been given like reference numerals throughout the drawings.

Figure 2:
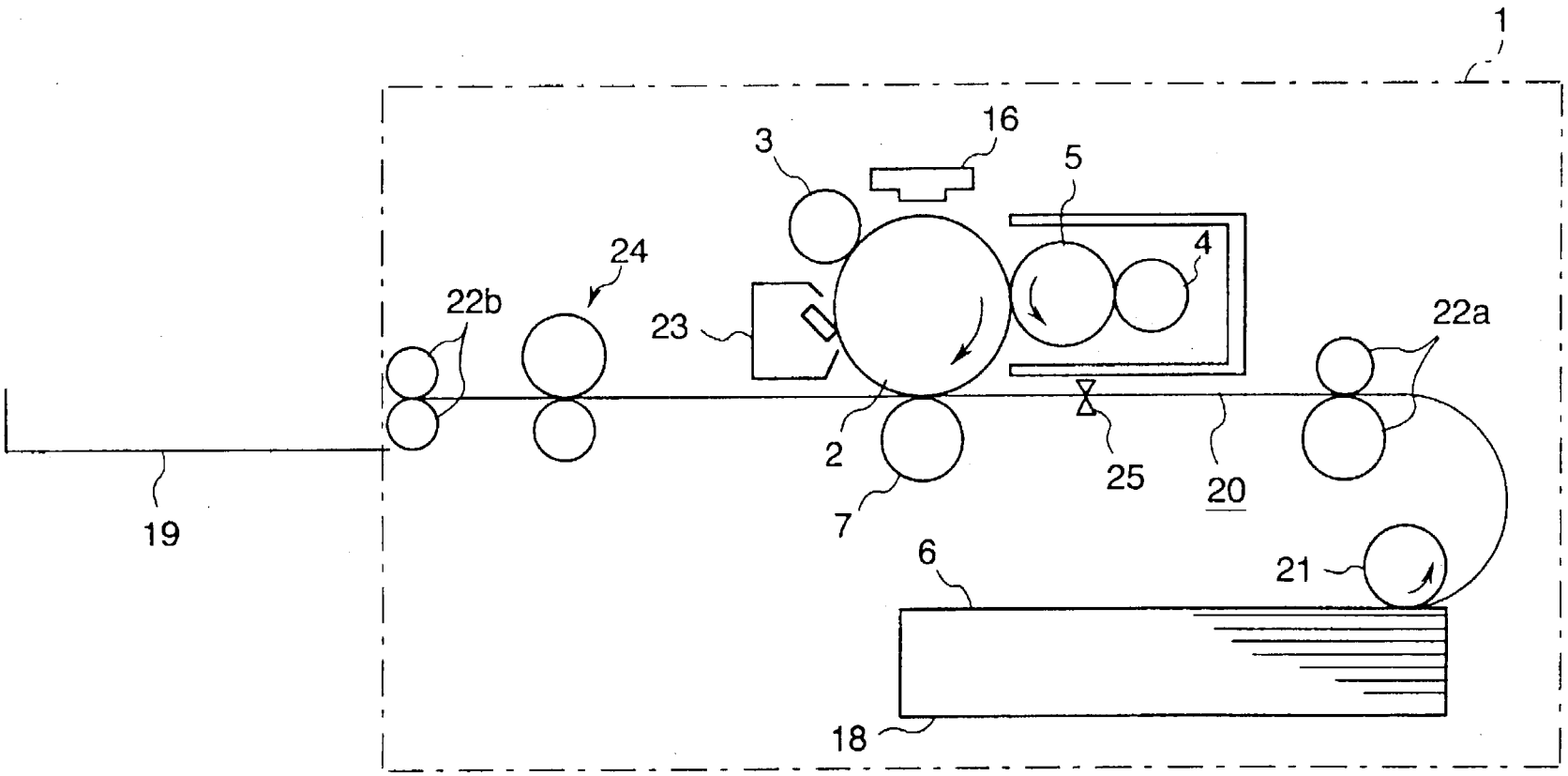
FIG. 2 illustrates the construction of the electrophotographic printer according to the invention.

The general construction of an electrophotographic printer will now be described. FIG. 2 illustrates the construction of an electrophotographic printer according to an embodiment. Referring to FIG. 2, an electrophotographic printer 1 is provided with a paper cassette 18 holding print paper 6 therein. A pick-up roller 21 feeds the print paper 6 from the paper cassette 18 to a transport path 20 along which the print paper 6 is transported from the paper cassette 18 to an exit stacker 19. The transport path 20 is provided with two pairs of feed rollers, one pair 22*a* upstream of a photosensitive drum 2 and another pair 22*b* immediately before the exit stacker 19.

The photosensitive drum 2 which holds a toner image on its surface is located between the two pairs of feed rollers 22*a* and 22*b*. Between the upstream feed rollers 22*a* and the photosensitive drum 2 is disposed a sensor 25 which detects the leading edge of the print paper 6 being transported along the transport path 20. Disposed around the photosensitive drum 2 are a charging roller 3, LED head 16, developing roller 5, transfer roller 7, and cleaning means 23. The charging roller 3 operates as a charging device for supplying static charges to the surface of the photosensitive drum 2. The LED head 16 illuminates the surface of the photosensitive drum 2 to form an electrostatic latent image on the photosensitive drum 2. The developing roller 5 operates as a developer which supplies the electrostatic latent image with negatively charged toner particles delivered by a toner delivering roller 4 from a toner cartridge, not shown. The transfer roller 7 is urged against the photosensitive drum 2 with a predetermined amount of force and transfers the toner image formed on the photosensitive drum 2 to the print paper 6. The cleaning means 23 removes the residual toner left on the photosensitive drum 2 after transfer of the toner image and removes the charges on the photosensitive drum 2.

A fixing device 24 for fixing the toner image on the print paper 6 is provided downstream of the photosensitive drum 2.

Figure 3:
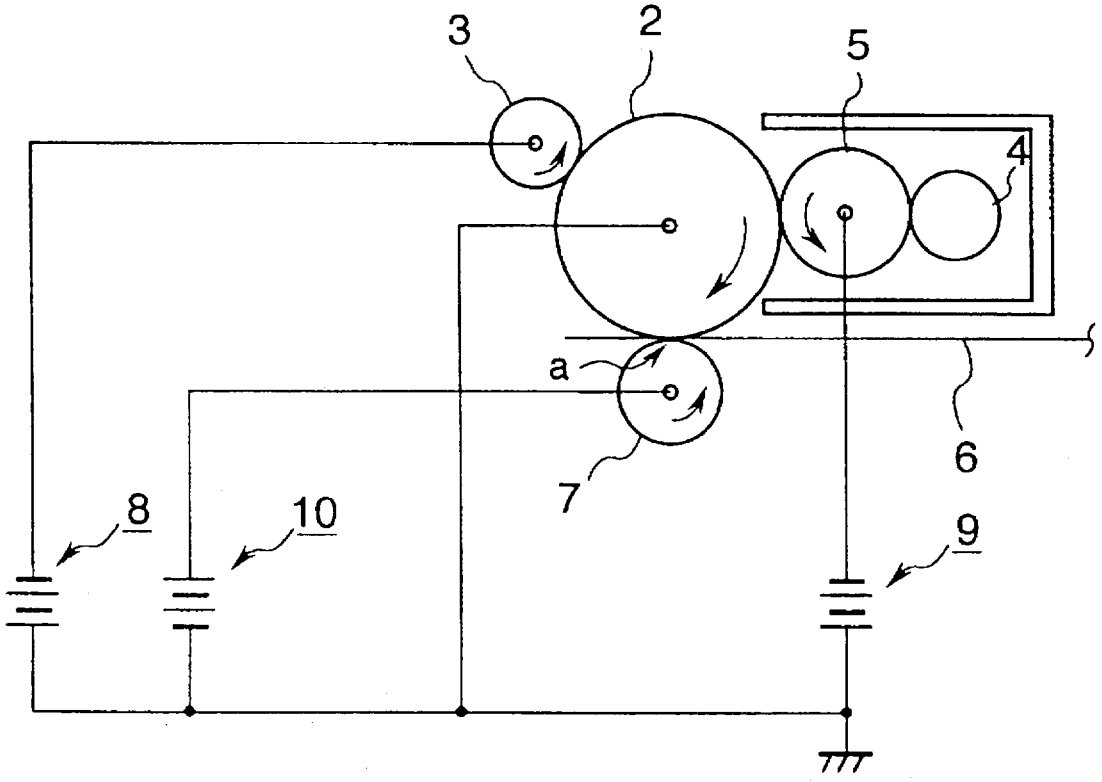
FIG. 3 illustrates a part of the construction shown in FIG. 2, showing power supplies to the respective rollers.
Figure 4:
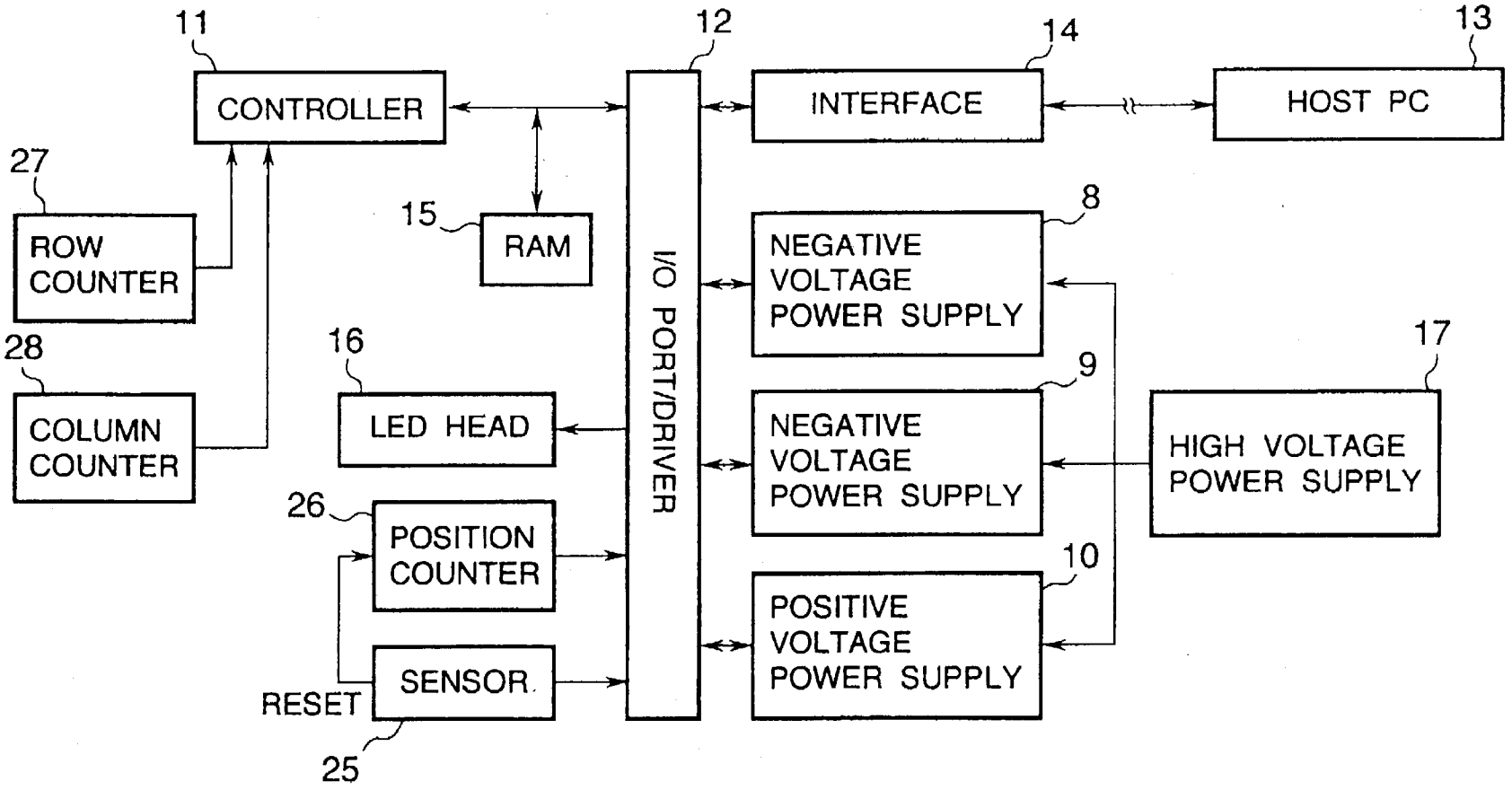
FIG. 4 is a block diagram showing a controlling section of the electrophotographic printer.

FIG. 3 illustrates a part of the construction shown in FIG. 2. As shown in FIG. 3, the charging roller 3 is connected to a negative voltage power supply 8. The developing roller 5 is also connected to a negative voltage power supply 9. The transfer roller 7 is connected to a positive voltage power supply 10 which supplies a positive voltage to the transfer roller 7 so as to transfer the toner image from the photosensitive drum 2 to the print paper 6. These rollers and power supplies are controlled by a later described controller 11 (FIG. 4).

A controlling section of the electrophotographic printer 1 will now be described. FIG. 4 is a block diagram showing a controlling section of the electrophotographic printer. Referring to FIG. 4, the controller 11 is connected to an I/O port/driver 12 through which signals are communicated between the controller 11 and the respective elements of the printer 1. The I/O port/driver 12 is connected to an interface 14 which receives print data supplied from an external apparatus, for example, a host PC 13 and sends data to the host computer 13. The I/O port/driver 12 is also connected to the LED head 16 which illuminates the photosensitive drum in accordance with print data from the controller 11.

The controller 11 is connected to a RAM 15 in which the data sent from the host computer 13 via the I/O port/driver 12 is stored. When transferring the toner image onto the print paper 6, the controller 11 searches the RAM 15 to detect the first logic "1" which indicates the start position of the print data, i.e., the first dot d (FIG. 5) on which toner particles are transferred onto the print paper 6. A position counter 26 and the sensor 25 are also connected to the controller 11 via the I/O port/driver 12.

The I/O port/driver 12 is also connected to the negative voltage power supplies 8 and 9 and the positive voltage power supply 10. These power supplies receives their voltages from a high voltage power supply 17. The controller 11 is also connected to a column counter 28 and a row counter 27.

Determination of Distance $L_3$

In the following description, time lengths $T_1$, $T_2$, and $T_3$, and distances $L_1$, $L_2$, and $L_3$ are defined in the same manner as in FIG. 9. As shown in FIG. 1, the voltage on the transfer roller 7 becomes more stable with increasing time length $T_1+T_2$ from activation of the CCC mode till the transferring device is switched from the CCC mode to the CVC mode. The more stable the output voltage is, the higher the quality of print is. Thus, in the present invention, the transferring device is switched from the CCC mode to the CVC mode in accordance with the distance $L_3$ between the leading edge of the print paper 6 and the print start position, i.e., the line in which the first black dot to be printed lies in the print area or image data.

Figure 8A:
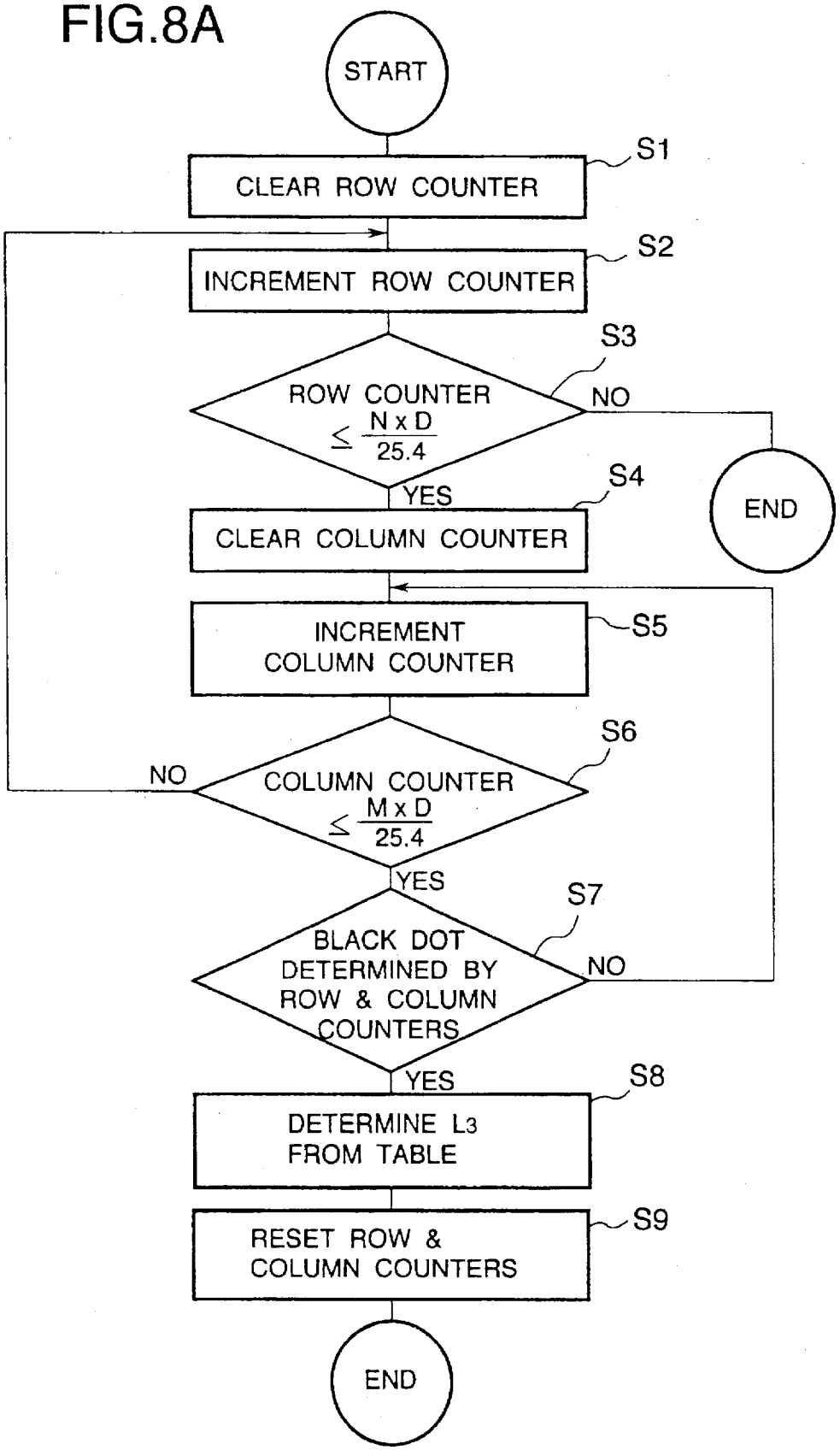
FIG. 8A illustrates a flowchart for determining the distance $L_3$.

Prior to the transfer of the toner image onto the print paper 6, the distance $L_3$ is determined on the basis of the print data sent from the host PC 13 by performing the steps in a later described flowchart in FIG. 8A.

Determination of the First Black Dot

Figure 5:
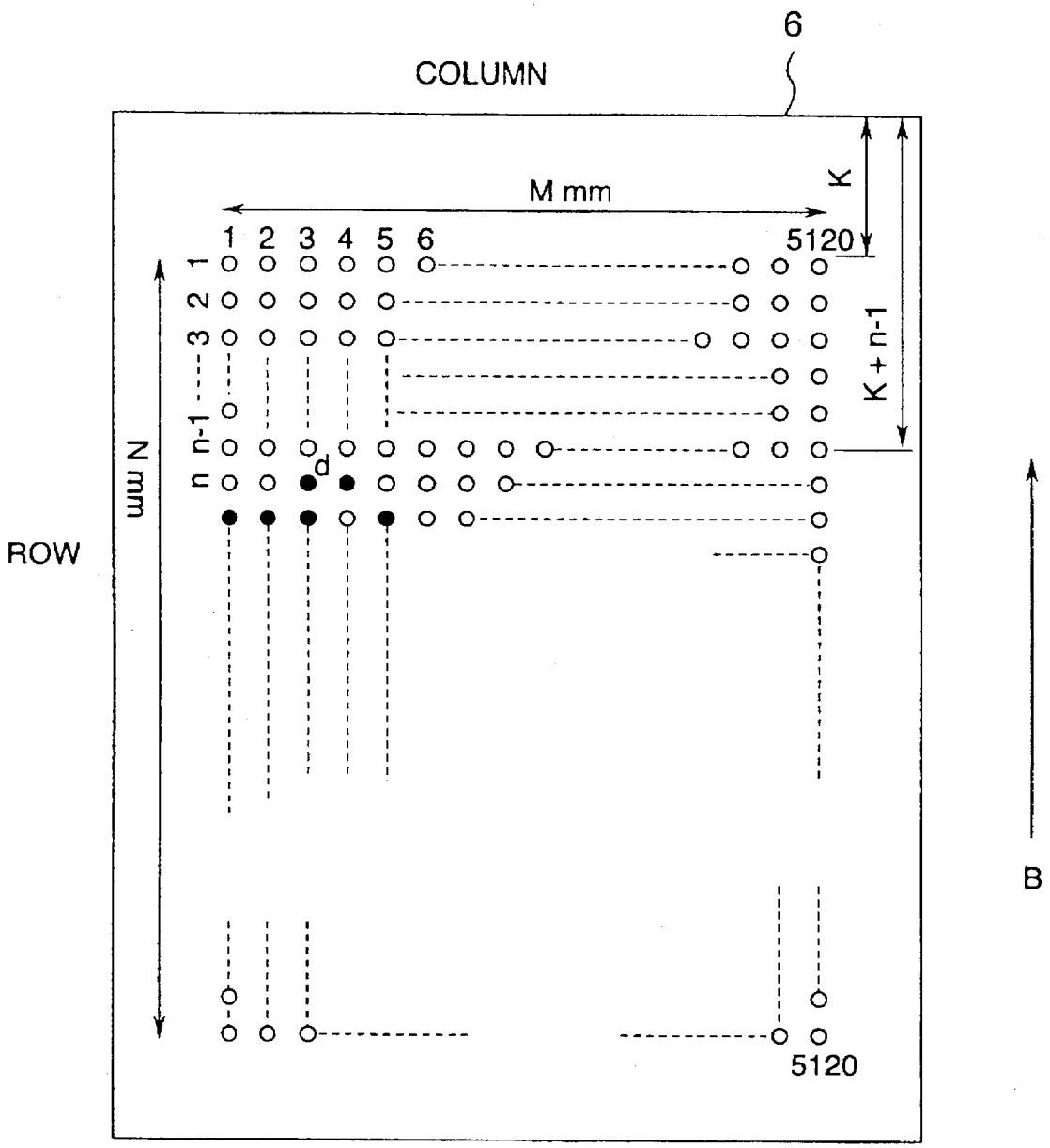
FIG. 5 illustrates the paper on which data is printed.

FIG. 5 illustrates an N mm by M mm print area on the print paper 6 in which area dots are arranged with a resolution of 600 DPI (dots per inch). K is a distance expressed in terms of the number of dots from the leading edge of the paper and defines a print-prohibiting area in which print is not allowed. The value of K is selected to be 100 dots equivalent to 4.23 mm when the resolution is 600 DPI. A black dot d in the n-th row is the first dot to be printed. The print area is searched for from left to right on a line-by-line basis to locate the first dot to be printed, indicated in black.

The print data sent from the host PC 13 is received via the I/O port/driver 12, stored into the RAM 15, and is developed into image data in the dot-mapped form at about the same time as is stored in a raster buffer, not shown, before the printing of each page starts. The controller 11 searches the raster buffer to locate the first black dot d (FIG. 5) in the image data to be printed. The row counter 27 counts the number of rows, i.e., the number of lines of dots in a direction in which the print paper 6 is transported, and the column counter 27 counts the number of columns, i.e., the number of dots in a direction perpendicular to the direction the print paper 6 is transported.

Figure 9:
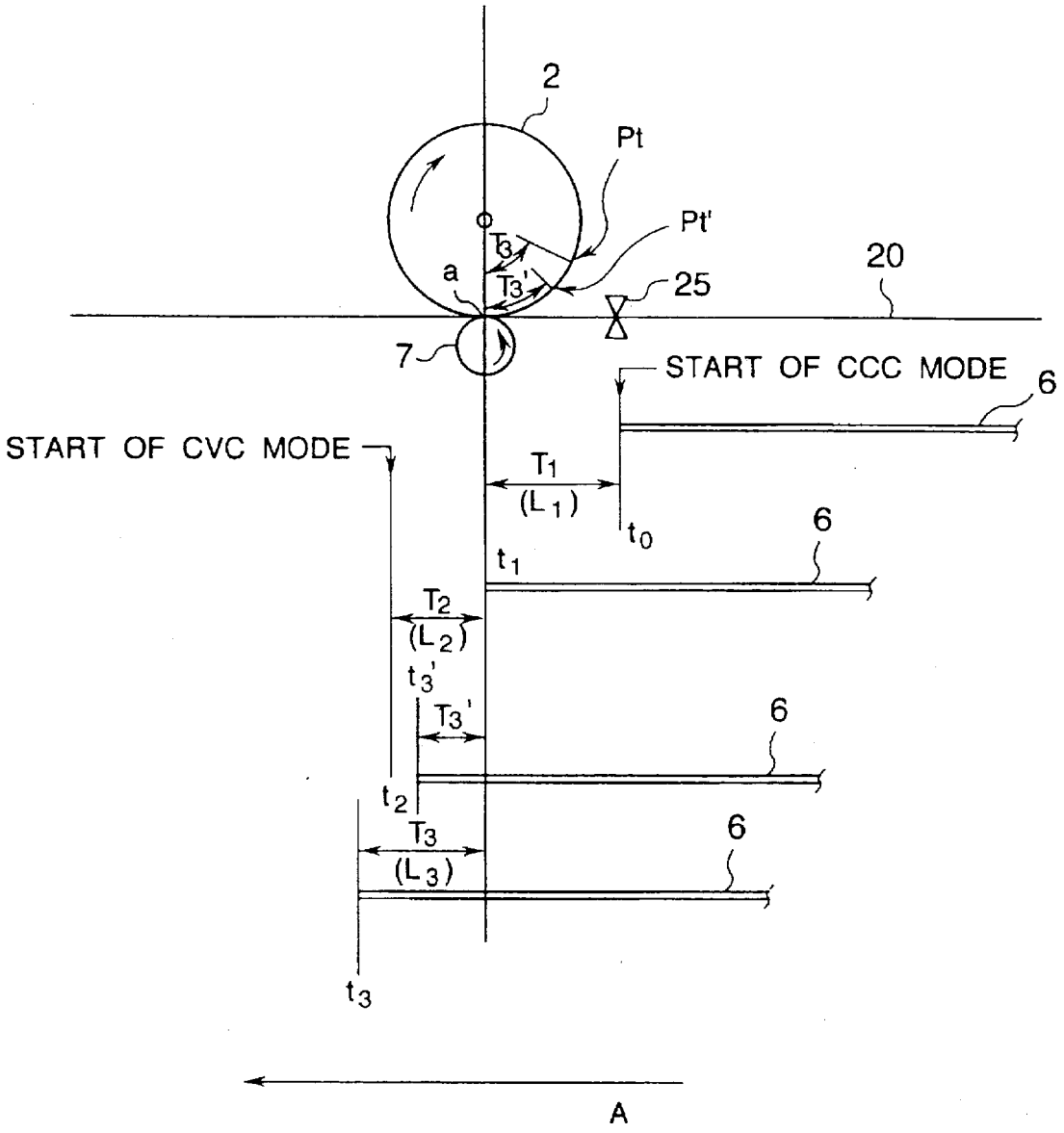
FIG. 9 illustrates the positional relation of leading edge of the paper and the contact position a at various times $t_0$, $t_1$, $t_2$, and $t_3$.

According to this embodiment, the distance $L_3$ from the leading edge of the print paper to the position of the first black dot on the print paper is determined for each page, and the timing of the switching from the CCC mode to the CVC mode is determined to be a little before the printing of the first black dot takes place, i.e., the part of the print paper where the first black dot is to be printed reaches the contact position a in FIG. 9. The distance $L_3$ is determined from the known distance K and the number (n−1) of lines of dots preceding the line in which the first black dot lies. The manner of determining the distance $L_3$ will now be described with reference to FIG. 8A. FIG. 8A illustrates a flowchart for determining the first black dot. At step S1, the row counter 27 is cleared. The row counter 27 counts the number of lines of dots from top to bottom in the print area of the image data shown in FIG. 5. At step S2, the row counter 27 counts up by one. At step S3, a check is made to determine whether the content of the row counter 27 is equal to or less than ND/25.4 where N is the distance in millimeters from top to bottom of the print area on one page, D is the printing resolution in terms of the number of dots per inch, the numeral 25.4 is a metric conversion of one inch. If the answer at step S3 is NO, then the search completes. If YES, the program proceeds to step S4 where the column counter 28 is cleared. At step S5, the column counter 28 counts up by one. At step S6, a check is made to determine whether the content of the column counter 28 is equal to or less than MD/25.4 where M is the distance in millimeters from left to right in a line to be printed, D is the printing resolution in terms of the number of dots per inch, the numeral 25.4 is a metric conversion of one inch. If the answer is NO at step S6, then the program returns to S2. If the answer is YES, then the program proceeds to step S7 where a check is made to determine whether the dot specified by the contents of the column counter 28 and row counter 27 is black, i.e., a dot to be printed. If the answer is NO at step S7, then the program returns to step S5. If the answer is YES at step S7, then the program proceeds to step S8 where the distance $L_3$ is determined on the basis of the distance K and the line in which the black dot d lies, the black dot being specified by the contents of column counter 28 and the row counter 27. The distance $L_3$ is given by $$L_3=[K+(n-1)]25.4/600 \quad (1)$$

Then, at step S9, the row counter 27 and column counter 28 are reset to zero for printing the next page.

Figure 6:
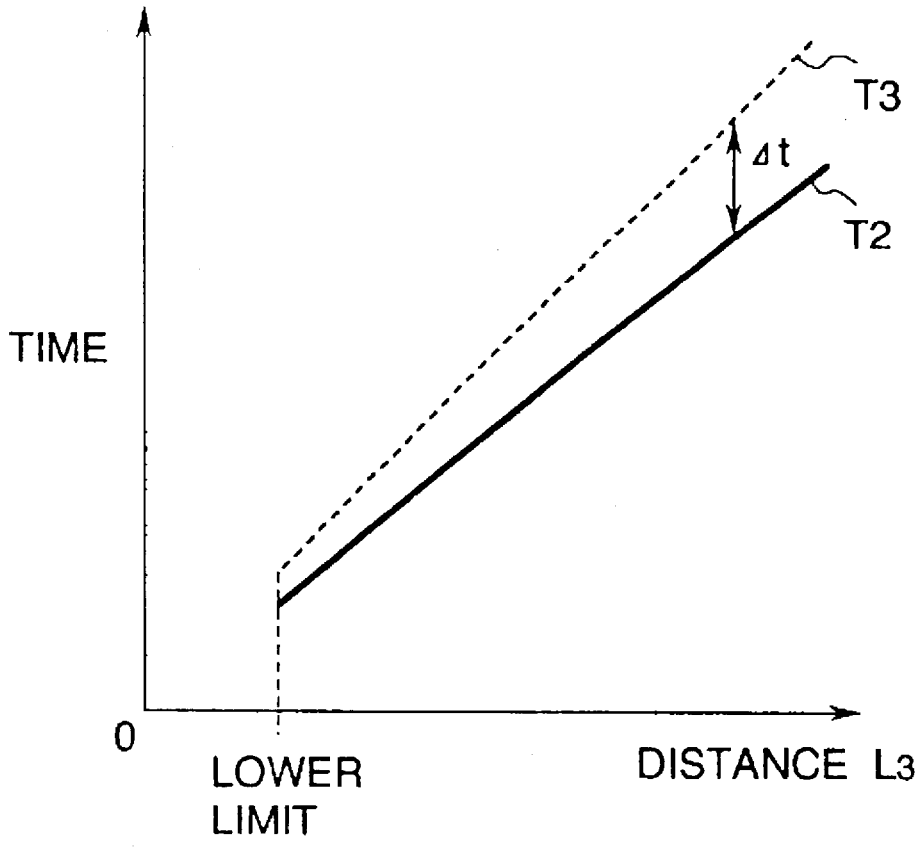
FIG. 6 is a graph showing the relation between the distance $L_3$ and time $T_2$ or $T_3$.

The values of $L_3$, n−1, and k+(n−1) are listed in FIG. 7. Once the value of K+(n−1) has been determined, the distance $L_3$ is determined by referring to a predetermined table shown in FIG. 7. For example, if the number (n−1) of lines before the first black dot is "19" where the content of the row counter 27 is n, then the number of K+(n−1) lines from the leading edge of the paper is "119". Therefore, the distance $L_3$ is 5.07 mm and the distance $L_2$ is set to 4.07 mm. FIG. 6 is a graph showing the relation between the distance $L_3$ and time $T_2$ or $T_3$. $T_2$ is a time length from the arrival of paper at the transferring device (contact point a) till the transferring device is switched from the CCC mode to the CVC mode and $T_3$ is a time length from the arrival of the print paper 6 at the transferring device (contact point a) till the transfer of the toner image begins. The value of $T_2$ is selected to satisfy $T2<T_3$. The ratio Δt of time length $T_2$ to time length $T_3$ is constant in FIG. 6. Alternatively, the value of $T_2$ may be selected so that the difference between $T_2$ and $T_3$ is constant.

Detection of the Position of the Paper 6

Figure 10:
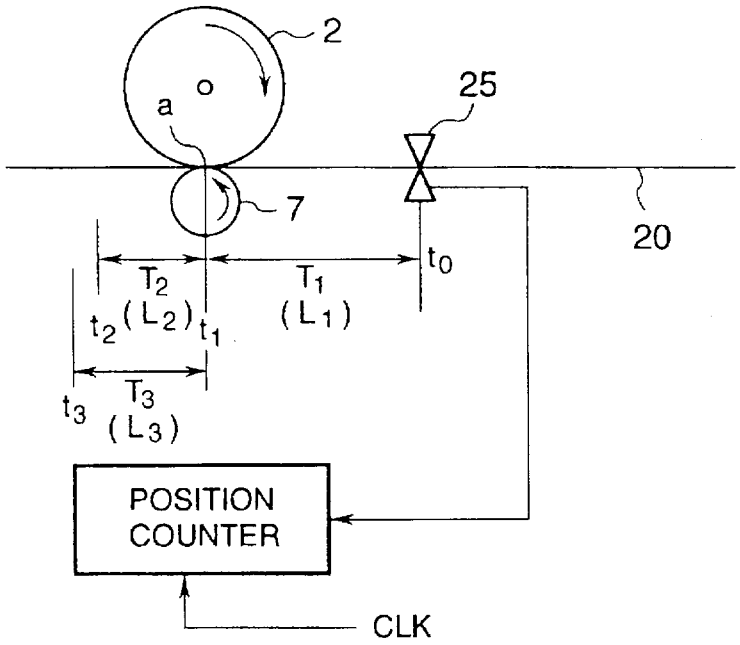

FIG. 10 illustrates the sensor 25 and the position counter 26 for detecting when the print paper 6 arrives at the contact point a. The print paper 6 is detected when it reaches the transfer position, i.e., contact point a as follows. Referring to FIG. 10, the sensor 25 detects the leading edge of the print paper 6 at time $t_0$ and the output of the sensor 25 resets the position counter 26. The position counter 26 begins counting the clock CLK. This clock CLK is the same clock as is used to form an electrostatic latent image on the photosensitive drum 2.

Figure 11:
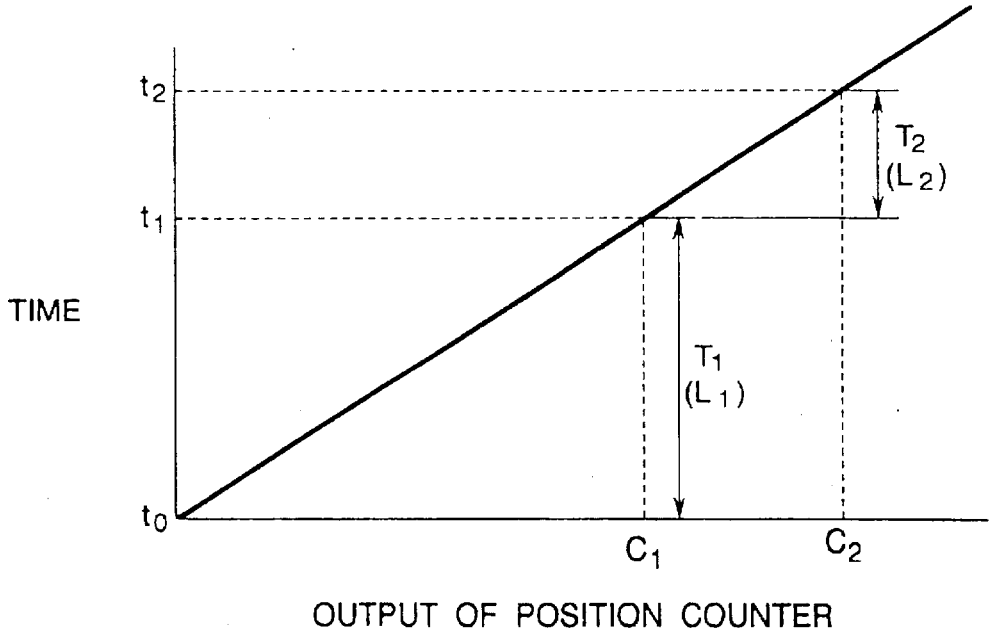
FIG. 11 illustrates the relationship between time and the output of the position counter.

FIG. 11 illustrates the relationship between time and the output of the position counter 26. When the count of the position counter 26 reaches a count $C_1$ at time $t_1$, it is determined that the print paper 6 has arrived at the contact point a. The count $C_1$ is determined by $$C_1=(L_1D)/25.4 \quad (2)$$

where $L_1$ is the distance in millimeters between the sensor 25 and the contact point a, D is the resolution in dots/in., and the numeral 25.4 is a metric conversion of an inch.

Likewise, the time $t_2$ at which the transferring device is switched from the CCC mode to the CVC mode is determined as follows: The value of $L_2$ in millimeters is determined from the table in FIG. 7 by the use of the distance $L_3$ determined by the operation described with reference to FIG. 8A. When the count of the position counter 26 reaches count $C_2$, the transferring device is switched from the CCC mode to the CVC mode at time $t_2$. The count $C_2$ is determined by $$C_2=(L_1+L_2)D/25.4 \quad (3)$$

where $L_1$ is the distance in millimeters between the sensor 25 and the contact point a, D is the resolution in dots/in., the numeral 25.4 is a metric conversion of an inch, and $L_2$ is the distance in millimeters for the print paper 6 to travel for a time period from the time the print paper 6 passes the contact point a until the transferring device is switched from the CCC mode to the CVC mode.

In FIG. 7, the minimum value of the distance $L_3$ is selected to be 4.23 mm. This is due to the fact that regulation of the voltage on the transfer roller 7 is not stable before $T_3$ corresponding to $L_3$, and if the switching from the CCC mode to the CVC mode were made when $L_3<4.23$ mm, the resultant print quality would be poor. For the distance $L_3 \geqq 9.31$ mm, the distance $L_2$ is fixed to be 6.4 mm which is long enough for almost any type of print medium. That is, the distance $L_2$ longer than 6.4 mm does not improve print quality any further.

Switching from the CCC mode to the CVC mode

Figure 8B:
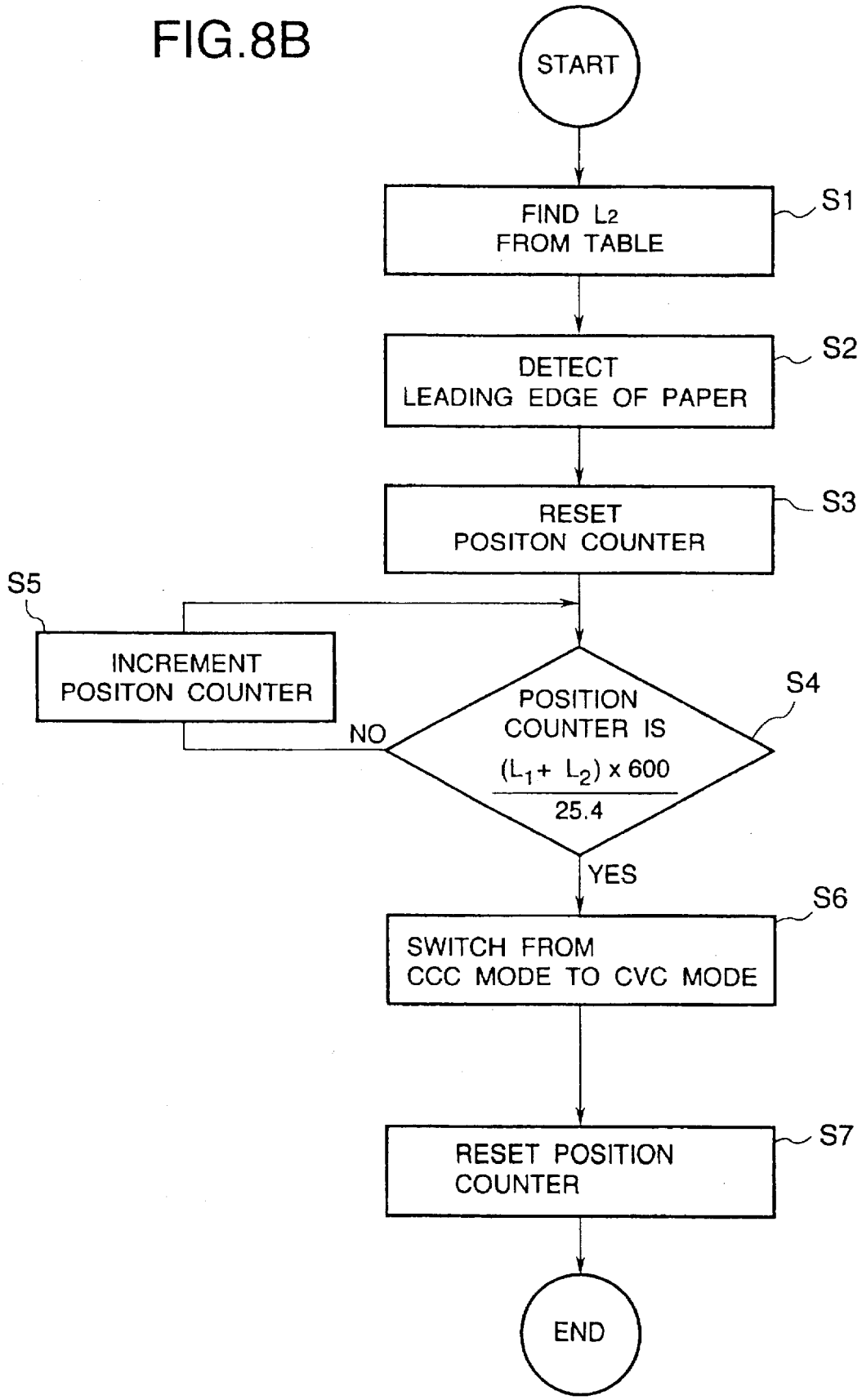
FIG. 8B illustrates a flowchart for determining the timing at which the transferring device is switched from the CCC mode to the CVC mode.

The timing at which the transferring device is actually switched from the CCC mode to the CVC mode is determined as follows:

FIG. 8B is a flowchart showing the steps of determining the timing for switching from the CCC mode to the CVC mode. At step S1, the value of $L_2$ is determined from the table in FIG. 7. As described above, the sensor 25 detects the leading edge of the paper 6 and resets the position counter 26 to zero at step S3. At step S4, a check is made to determine whether the count C of the position counter 26 is $C=C_2=(L_1+L_2)D/25.4$. If the answer is NO at step S4, then the program proceeds to step S5 where the position counter counts up by one. The paper 6 is further transported till the count C of the position counter 26 reaches $C_2$. If the answer is YES at step S4, then the transferring device is switched from the CCC mode to the CVC mode at step S6 since the count $C=C_2$ indicates that the time $T_2$ has elapsed from the arrival of the paper at the contact point a. At step S7, the position counter is reset to zero to be ready for printing the next page. The transfer of a toner image begins at time $t_3$ in FIG. 9, after the switching from the CCC mode to the CVC mode.

Operation of the Printer

The overall operation of the printer of the invention will now be described with reference to FIGS. 1 and 11. The controller 11 sends control signals to the negative voltage power supplies 8 and 9 and the positive voltage power supply 10 so that voltages are supplied to the charging roller 3, developing roller 5, and transfer roller 7 receive voltages, respectively. The positive voltage power supply 10 outputs a positive voltage in the CCC mode in response to a power-on signal, the positive voltage increasing gradually.

The controller 11 causes the LED head 16 to form an electrostatic latent image on the photosensitive drum 2 on which negative charges have been applied. Then, negatively charged toner is deposited on the electrostatic latent image by the developing roller 5.

FIG. 1 is a timing chart illustrating the transfer operation of an electrophotographic printer according to the present invention. Referring to FIGS. 1 and 11, the print paper 6 is fed from the paper cassette 18 into the transport path 20 and the leading edge of the print paper 6 arrives at the contact point a a time length $T_1$ after time $t_0$ when the positive voltage power supply 10 turns on. The print paper 6 is further transported the distance $L_2$ and the positive voltage power supply 10 is switched from the CCC mode to the CVC mode at time $t_2$. Then, the paper is still further transported the distance $L_3-L_2$ and the transfer operation of image begins at time $t_3$. After the transfer operation has completed and the trailing edge of the print paper 6 has passed the contact point a, the controller 11 turns off the power-on signal at time $t_4$. The toner image transferred onto the print paper 6 is fixed by the fixing device 24 and the print paper 6 is then ejected to the exit stacker 19.

The invention allows switching of the transferring device from the CCC mode to the CVC mode in accordance with the distance between the leading edge of the paper and the line in which the first black dot to be printed lies in the print area or image data. Thus, the invention makes it possible to print in wider area of the print paper 6 than the prior art, without degrading the print quality.

What is claimed is:

1. An electrophotographic printer having a transferring device for transferring a toner image from a photosensitive dram to a print area on a print medium, said transferring device operating in a constant-current control mode and then in a constant-voltage control mode after the constant-current mode, comprising:

a calculating section for calculating a first distance between a leading edge of the print medium and a line to be first printed in the print area; and a controlling section for switching the transferring device from the constant-current control mode to the constant-voltage control mode when the print medium has been transported a second distance after the print medium arrives at the photosensitive drum, said second distance being shorter than said calculated first distance and varied in accordance with said calculated first distance.

2. The electrophotographic printer according to claim 1, wherein said second distance is selected in accordance with a length of said first distance.

3. The electrophotographic printer according to claim 1, wherein said calculating section includes:

a row counter for counting the number of lines of dots in the print area, said lines of dots extending in a direction perpendicular to a direction in which the print medium is transported; and wherein said controlling section determines a third distance between a leading edge of the print area and said line to be first printed in the print area on the basis of content of said row counter.

4. The electrophotographic printer according to claim 1, further including:

a sensor for detecting a leading edge of the print medium being transported toward the photosensitive drum; and a position counter for counting a first time length required for the print medium to advance from where the print medium is detected by said sensor to a photosensitive drum, and for counting a second time length required for the print medium to advance said second distance.

5. The electrophotographic printer according to claim 4, wherein said transferring device is switched from the constant-current control mode to the constant-voltage control mode when said position counter has counted up a sum of said first time length and said second time length.

6. The electrophotographic printer according to claim 1, wherein said second time length is selected to have a predetermined ratio to a third time length required for the print medium to advance said first distance.

7. The electrophotographic printer according to claim 1, wherein said second time length is determined so that a difference between said second time length and said third time length is substantially constant.

* * * * *